US007866118B1

(12) United States Patent
Hamblin et al.

(10) Patent No.: US 7,866,118 B1
(45) Date of Patent: Jan. 11, 2011

(54) STORM DOOR ASSEMBLY

(75) Inventors: Ryan J. Hamblin, Apache Junction, AZ (US); William E. Earl, Black Canyon City, AZ (US); Michael A. Mueller, Phoenix, AZ (US)

(73) Assignee: Unique Home Designs, Inc., Gilbert, AZ (US)

( * ) Notice: Subject to any disclaimer, the term of this patent is extended or adjusted under 35 U.S.C. 154(b) by 0 days.

(21) Appl. No.: 12/211,672

(22) Filed: Sep. 16, 2008

(51) Int. Cl.
*E04C 2/54* (2006.01)

(52) U.S. Cl. ..... 52/784.1; 52/204.1; 52/204.62; 52/458; 160/179; 160/369

(58) Field of Classification Search ..... 52/202, 52/203, 204.1, 204.61, 204.64, 204.65, 204.66, 52/204.591, 455, 458, 782.1, 783.1, 782.24, 52/784.1; 160/179, 369
See application file for complete search history.

(56) References Cited

U.S. PATENT DOCUMENTS

| | | | | | |
|---|---|---|---|---|---|
| 1,275,531 | A | | 8/1918 | Clews | |
| 1,515,091 | A | | 11/1924 | Brower et al. | |
| 1,573,194 | A | * | 2/1926 | Roe | 160/91 |
| 1,704,869 | A | | 3/1929 | Pierson | |
| 1,764,118 | A | | 6/1930 | Potterf | |
| 1,954,640 | A | * | 4/1934 | Loper | 160/128 |
| 2,548,681 | A | * | 4/1951 | Oswald | 292/240 |
| 2,634,146 | A | * | 4/1953 | Johnson | 292/194 |
| 2,665,155 | A | * | 1/1954 | Figley | 292/194 |
| 2,818,610 | A | | 1/1958 | Pengelly | |
| 4,102,545 | A | | 7/1978 | Jay | |
| 4,554,770 | A | | 11/1985 | Anders | |
| 5,469,666 | A | | 11/1995 | Lewis, Jr. | |
| 6,003,279 | A | * | 12/1999 | Schneider | 52/481.1 |
| 2008/0018117 | A1 | | 1/2008 | Yeremian | |

* cited by examiner

*Primary Examiner*—Richard E Chilcot, Jr.
*Assistant Examiner*—Theodore Adamos
(74) *Attorney, Agent, or Firm*—Booth Udall, PLC

(57) ABSTRACT

A storm door assembly for a doorway to a building comprises a frame configured for hinged mounting at a doorway of a building. The frame comprises an opening through the frame, the opening comprising a depth and at least two channels disposed in parallel around an inner surface of the depth. At least two removable frame inserts are provided, each comprising a front surface, a rear surface, and an insert perimeter comprising a plurality of recesses positioned about the perimeter. A plurality of twisting cams are each disposed within one of the plurality of recesses and not extending beyond the front and rear surfaces, and the at least two frame inserts are each held in a fixed position with respect to the frame via placement of the twisting cams within the at least two channels.

15 Claims, 12 Drawing Sheets

STORM DOOR ASSEMBLY

BACKGROUND

1. Technical Field

Aspects of this document relate generally to storm door assemblies for doorways to buildings.

2. Background Art

Storm door assemblies are commonly used in many residential, commercial and industrial buildings in order to provide ingress and egress where desired. Storm door assemblies commonly comprise a frame and different types of panel inserts for different applications that may be used singly or in combination such as, among other kinds, glass panels to resist entry of weather elements while allowing sunlight to enter and/or screened panels to allow the entry of breezes while resisting the entry of insects. Notwithstanding, conventional storm door assemblies may require unwieldy or otherwise cumbersome adjustments in order to add or remove a panel insert to a frame.

SUMMARY

In one aspect, a storm door assembly for a doorway to a building comprises a frame configured for hinged mounting at a doorway of a building, the frame comprising an opening through the frame, the opening comprising a depth and at least two channels disposed in parallel around an inner surface of the depth. The assembly comprises at least two removable frame inserts each comprising a front surface, a rear surface, and an insert perimeter comprising a plurality of recesses positioned about the perimeter. A plurality of twisting cams are each disposed within one of the plurality of recesses and do not extend beyond the front and rear surfaces of the removable frame inserts. The at least two frame inserts are each held in a fixed position with respect to the frame via placement of the twisting cams within the at least two channels.

Particular implementations of a storm door assembly for a doorway to a building may include one or more of the following features and aspects. The at least two frame inserts may be stackable so that the front surface of a first insert of the at least two inserts is in contact with and substantially coextensive with the rear surface of a second insert of the at least two inserts within the depth of the frame when held in its fixed position with respect to the frame. The at least two channels may be disposed concentrically around the inner surface of the frame depth. The at least two channels may be coextensive with the perimeter of the opening through the frame. The at least two channels may comprise one or more discrete, non-contiguous channels. The at least two frame inserts may each comprise a groove disposed along the insert perimeter and located between the front surface and the rear surface; wherein the plurality of recesses each comprises a penannular opening through the front surface into the groove at the perimeter. The groove may be coextensive with the insert perimeter. The groove may comprise one or more discrete, non-contiguous grooves. The plurality twisting cams disposed within the plurality of recesses may each be rotatably coupled within the groove of the at least two frame inserts. The one or more twisting cams may rotate coplanarly with respect to the one or more frame inserts. The at least two frame inserts may each further comprise an annular opening through the rear surface and each of the plurality of twisting cams comprises a pivot rotatably coupled into the annular opening of its respective recess. The plurality of twisting cams may each comprise an engagement tab. The engagement tab may comprise a resilient deformable engagement structure. The engagement tab may further comprise a rounded engaging surface opposite the resilient deformable engagement structure. An engaging surface of the engagement tab may be rounded. The engagement tab may be rotatable between an unlocked position and a locked position, wherein in the unlocked position the engagement tab is contained within the groove of its respective insert and in the locked position at least a portion of the engagement tab extends from the groove of its respective insert.

In another aspect, a storm door assembly for a doorway to a building comprises a frame configured for hinged mounting at a doorway of a building, the frame comprising an opening through the frame, the opening comprising a depth and at least one channel disposed around an inner surface of the depth, the channel comprising first and second sides. The assembly comprises at least one removable frame insert comprising a front surface, a rear surface, and an insert perimeter comprising a plurality of recesses positioned about the perimeter. A plurality of twisting cams are each rotatably disposed within one of the plurality of recesses and do not extend beyond the front and rear surfaces, each twisting cam comprising an engagement tab comprising a rounded engaging surface on a first side and a resilient deformable engagement structure on a second side opposite the first side. When assembled, the at least one removable frame insert is seated in the frame opening and the engagement tabs of the plurality of twisting cams is impinged between the first and second sides of the at least one channel of the frame opening with the rounded engaging surface in contact with the first side and the resilient deformable engagement structure in contact with the second side.

Particular implementations of a storm door assembly for a doorway to a building may include one or more of the following. The at least one removable frame insert may comprise at least two removable frame inserts each disposed within the at least one channel of the frame. The at least one frame insert may comprise a groove disposed along the insert perimeter and located between the front surface and the rear surface; wherein the plurality of recesses each comprises a penannular opening through the front surface into the groove at the perimeter. The plurality of twisting cams may each rotate coplanarly with respect to the at least one frame insert.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Storm door assemblies will hereinafter be described in conjunction with the appended drawings, where like designations denote like elements, and.

DESCRIPTION

This document features a storm door assembly. There are many features of a storm door assembly disclosed herein, of which one, a plurality, or all features may be used in any particular implementation.

Whether a storm door assembly is used in a residential, commercial, or industrial applications, the ability to easily and quickly insert, fix in position, and remove frame inserts from a storm door frame is helpful to many users of storm door assemblies. In addition, the ability to simplify the manufacture of storm door assemblies is helpful to many manufacturers of storm door assemblies.

Figure 1:
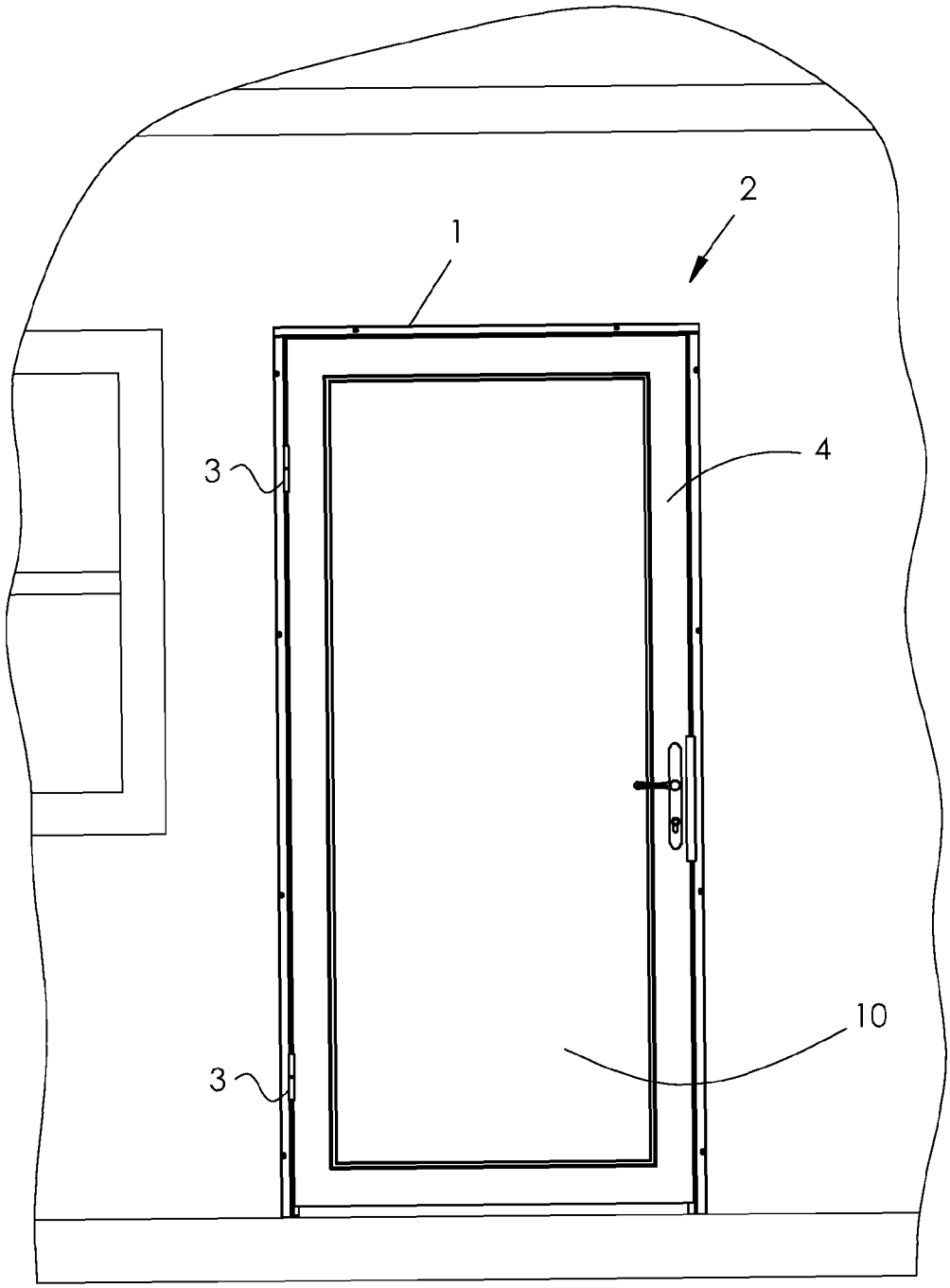
FIG. 1 is a perspective view of a storm door assembly hingeably mounted at a doorway of a building.

There are a variety of possible storm door assembly implementations. Notwithstanding, FIG. 1 illustrates a particular implementation of a storm door assembly 2 mounted in a doorway of a building. Frame 4 is hingeably mounted within doorway 1 via one or more hinges 3. As will be described at greater length below, insert 10 is removably coupleable with an opening through frame 4.

Figure 2:
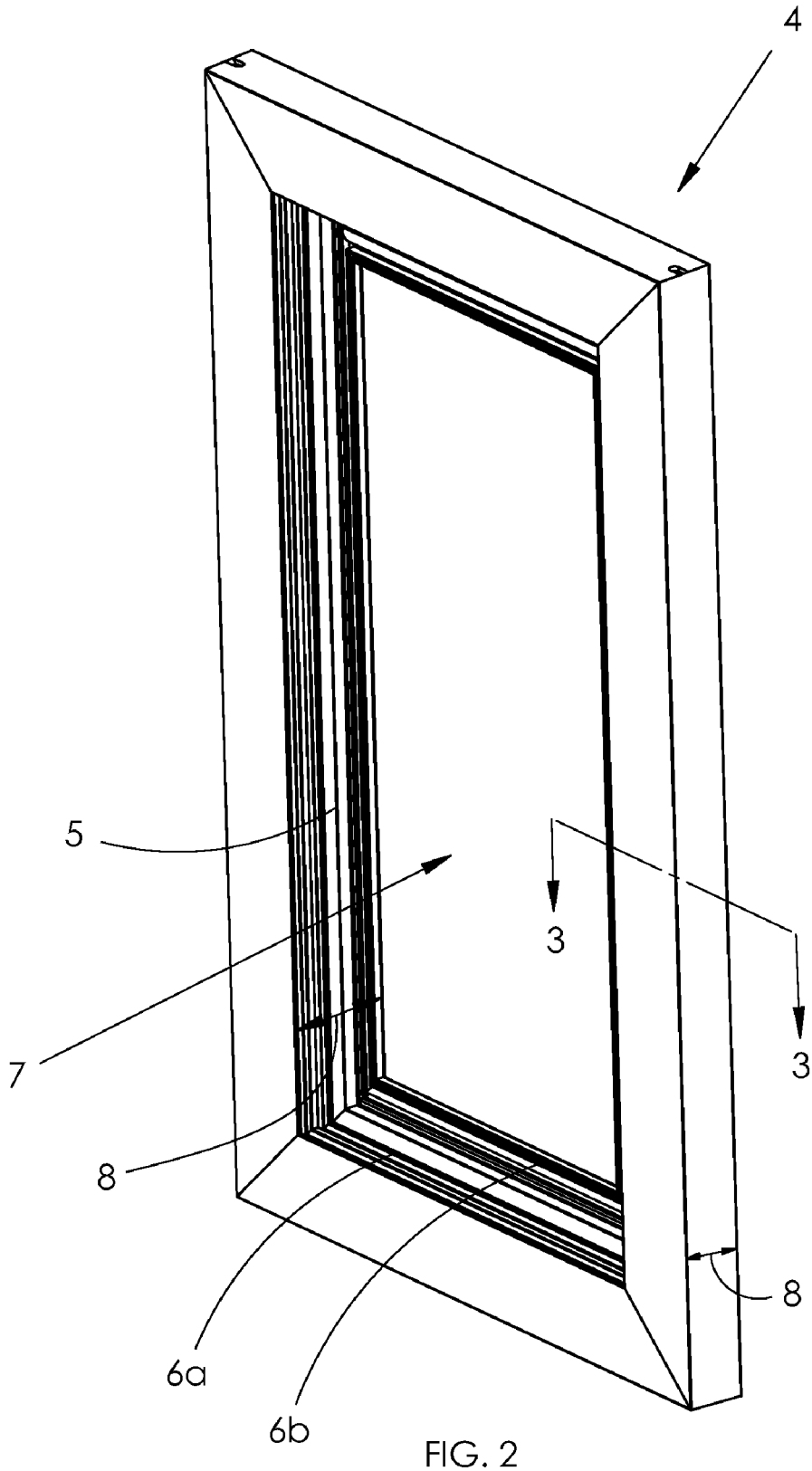
FIG. 2 is a perspective view of the frame shown in FIG. 1.
Figure 3:
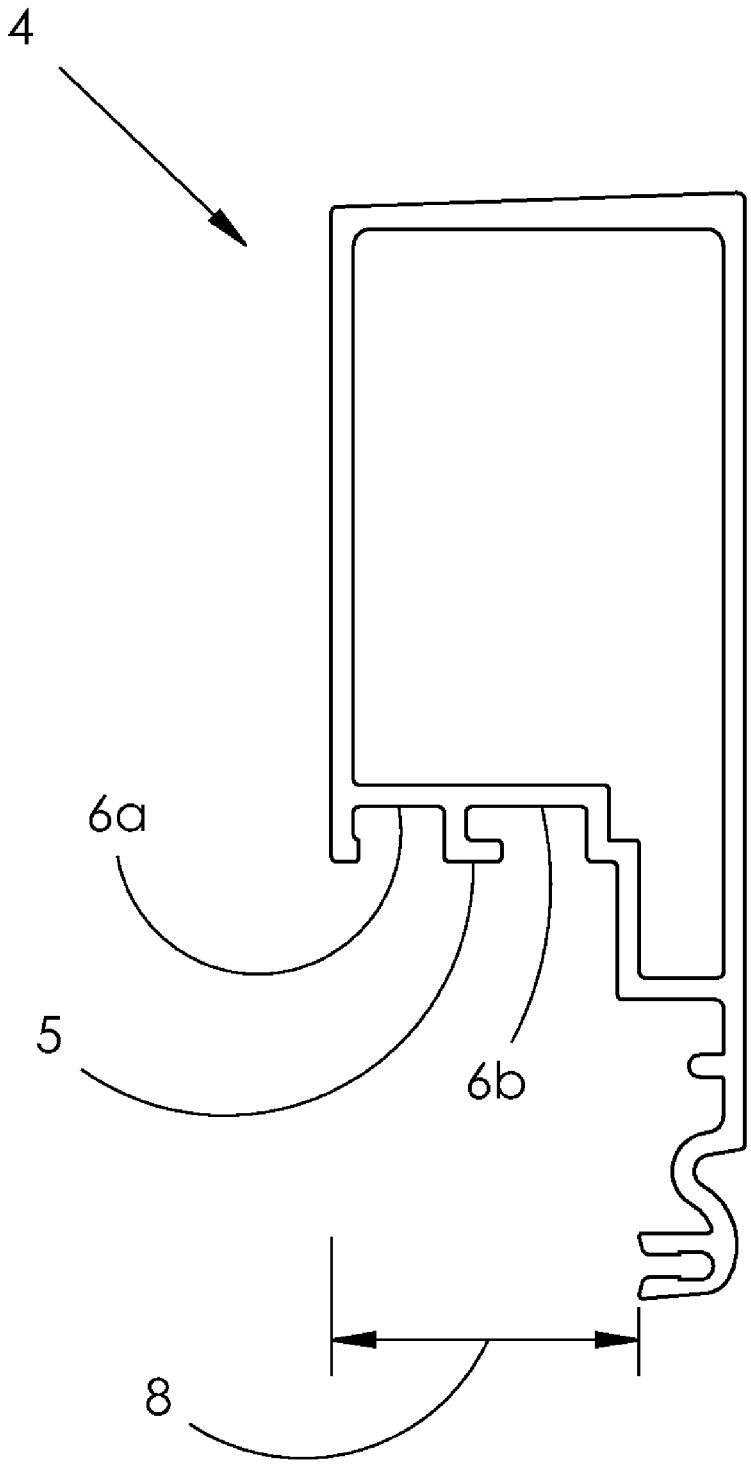
FIG. 3 is a cross-sectional view of the frame shown in FIG. 2, taken along cross-sectional line 3-3.

Referring now to FIGS. 2 and 3, a particular implementation of a frame 4 is illustrated. Opening 7 passes through frame 4 and comprises a depth 8 and at least two channels 6*a*, 6*b* arranged or disposed in parallel around an inner surface 5 of the depth 8. In particular implementations, the at least two channels 6*a*, 6*b* may be disposed concentrically around the inner surface 5 of the frame depth 8, that is, they may share a common center point. In other particular implementations, the at least two channels 6*a*, 6*b* are each substantially coextensive with the perimeter of the opening 7 through frame 4. In still other particular implementations, the at least two channels 6*a*, 6*b* comprise one or more separate, non-connecting channels. In any event, the at least two channels 6*a*, 6*b* are sized and shaped to allow the placement of a engagement tab (twisting cam) therein, as described more fully below. It will be understood that the magnitude of depth 8 may be varied to accommodate a greater or fewer number of channels 6*a*, 6*b*. Also, in particular implementations, the width of the two or more channels 6*a*, 6*b* may vary. Accordingly, while two channels are illustrated, more than two channels may be disposed within the depth 8.

Figure 4:
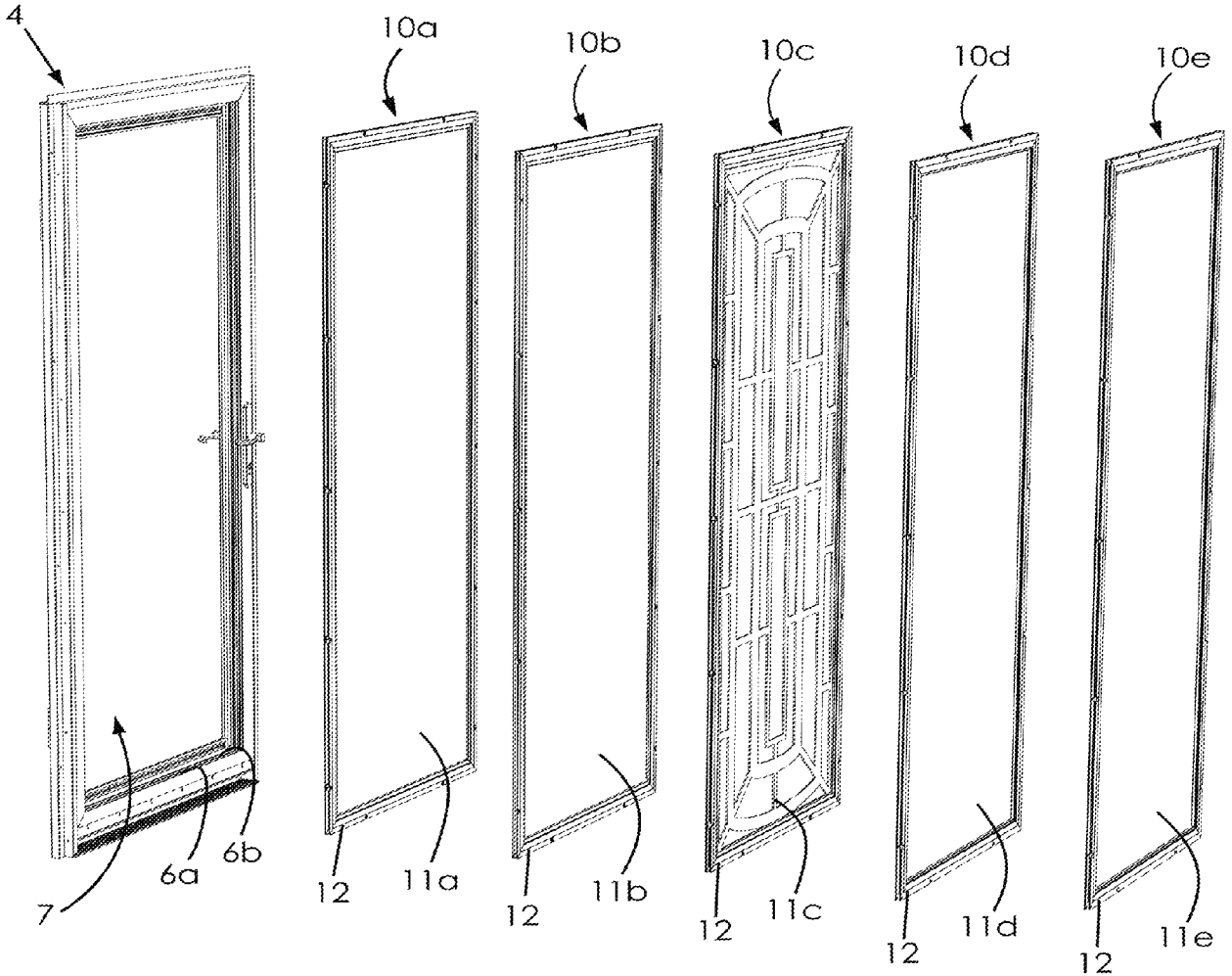
FIG. 4 is a perspective view of a variety of non-limiting examples of removable frame inserts.

FIG. 4 illustrates a particular implementation of a frame 4, shown with a variety of possible inserts 10, which are shown as non-limiting examples of the many types of inserts that may be provided in connection with this disclosure. In particular, inserts 10*a*-10*e* may vary at least according to the character of the insert panel 11 provided although, in particular implementations, each insert's outer frame 12 may be identical. Therefore, by way of non-limiting example: insert panel 11*a* may comprise a tempered glass panel; insert panel 11*b* may comprise a bug screen panel; insert panel 11*c* may comprise a skin assembly (a decorative panel that may include one or more solid portions and/or one or more cutout portions); insert panel 11*d* may comprise a perforated metal panel; and insert panel 11*e* may comprise a sun screen panel. Of course, it will be understood that many other types of insert panels 11 may be provided, consistent with the disclosures contained herein.

Figure 7:
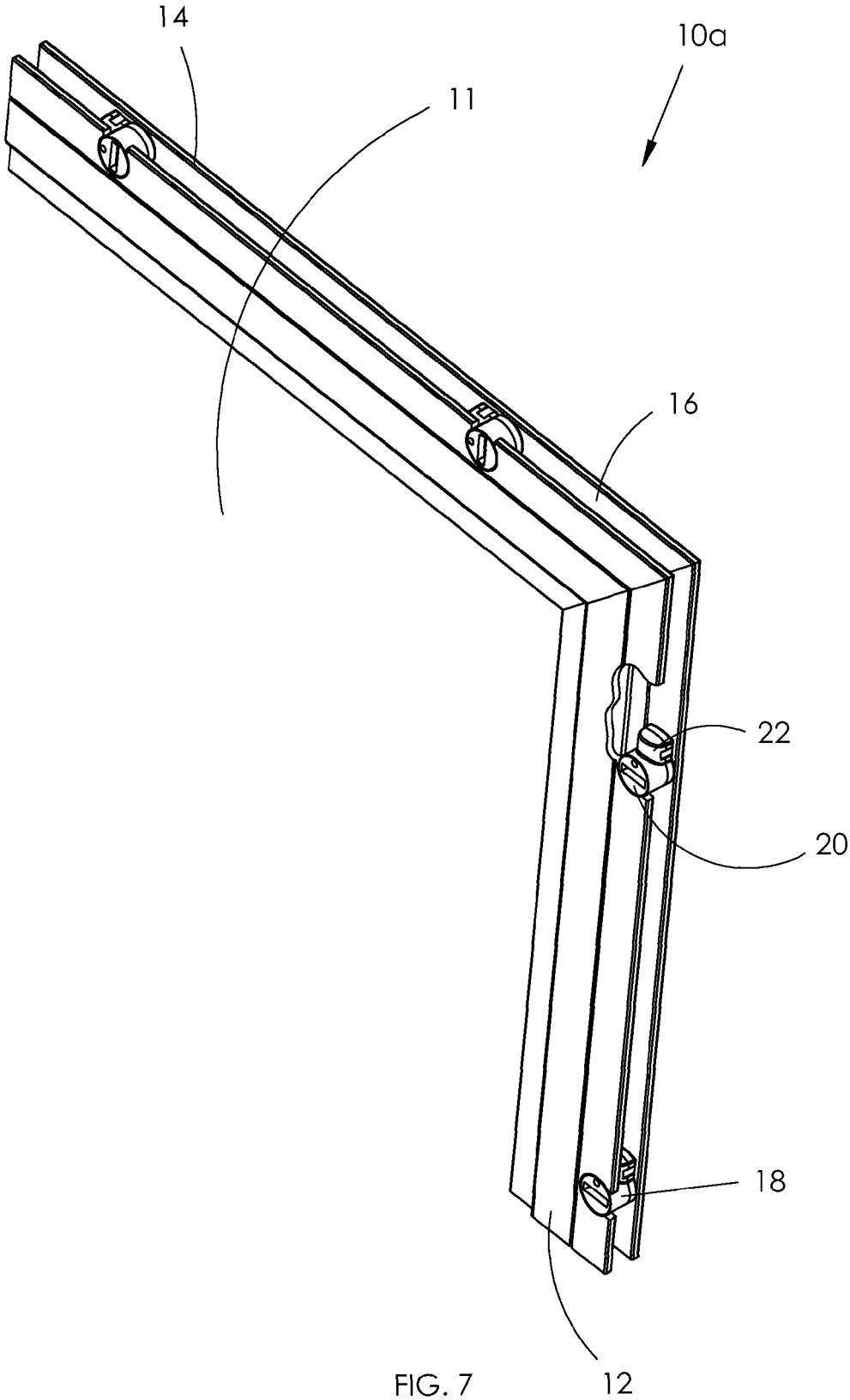
FIG. 7 is a front cut-away view of the first particular implementation of the removable insert, showing a twisting cam in an unlocked position.
Figure 8:
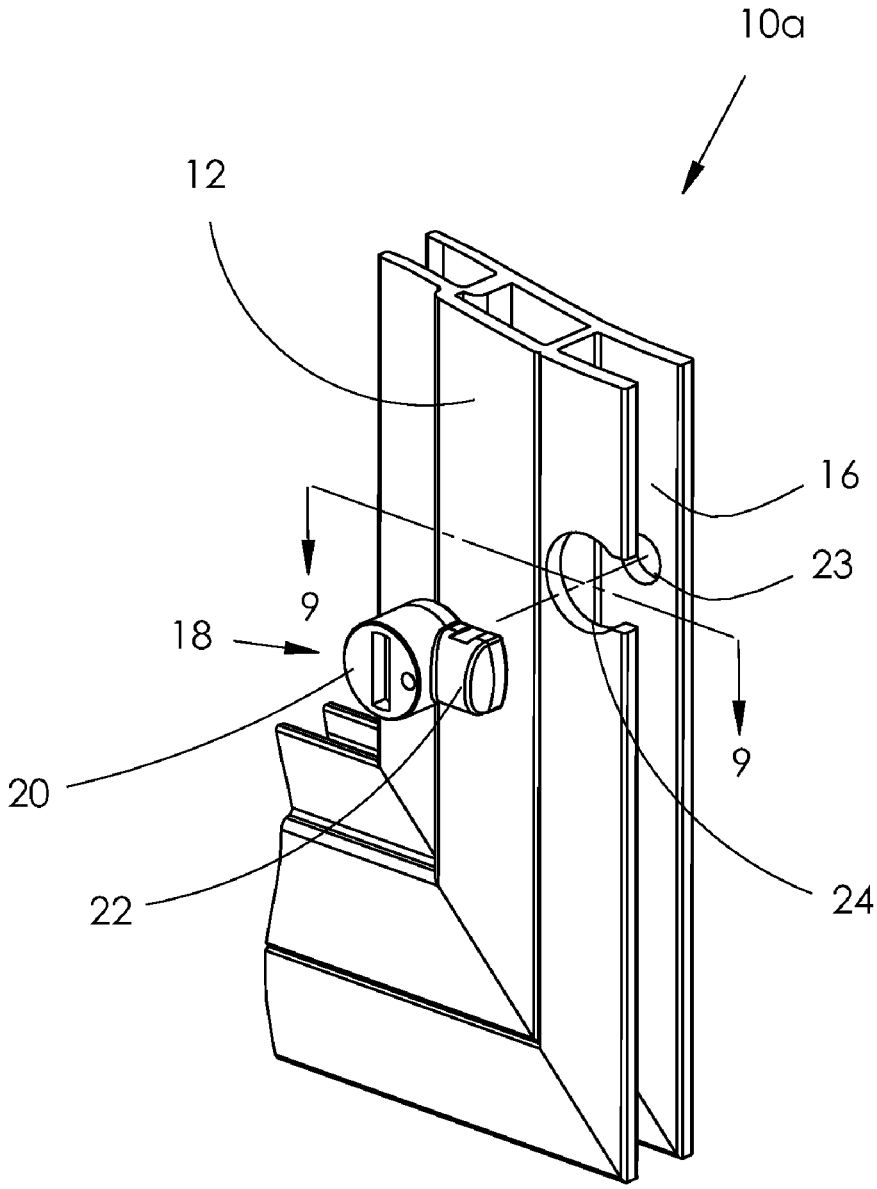
FIG. 8 is a exploded view of a first particular implementation of a removable frame insert with a engagement tab in a locked position.

Referring now to FIGS. 5-8, a particular implementation of an insert 10 will now be described. Insert 10 comprises insert outer frame 12 (which comprises insert perimeter 14) and insert panel 11, which is coupled within an insert opening 13. Insert 10 further comprises front surface 15 and rear surface 17. Insert outer frame 12 (of insert 10) comprises one or more grooves 16 disposed along the insert perimeter 14 and located between the front surface 15 and the rear surface 17. In particular implementations, the one or more grooves 16 may be coextensive with insert perimeter 14. In other particular implementations, the one or more grooves 16 may comprise one or more separate, non-connecting grooves. In any event, the one or more grooves 16 are sized and shaped to accept engagement tab 22 of twisting cam 18 when the engagement tab 22 is in an unlocked position (described more fully below). In addition to the foregoing, insert outer frame 12 front surface 15 comprises a plurality of recesses 24 positioned about the perimeter 14 which, in particular implementations, may comprise a penannular opening through front surface 15 into the groove 16 at the perimeter, as best seen in FIG. 8. A plurality of twisting cams 18 are provided, and each twisting cam 18 is disposed within one of the plurality of recesses 24, without the twisting cam 18 extending beyond the front surface 15 and the rear surface 17. Each twisting cam comprises a body 20 (which may comprise a slot or other feature to allow rotation of twisting cam 18 via the application of a tool thereto) and an engagement tab 22. Engagement tab 22 is sized and shaped to allow for the placement of engagement tab 22 within one or more channels 6 of frame 4 (FIG. 2).

Figure 5:
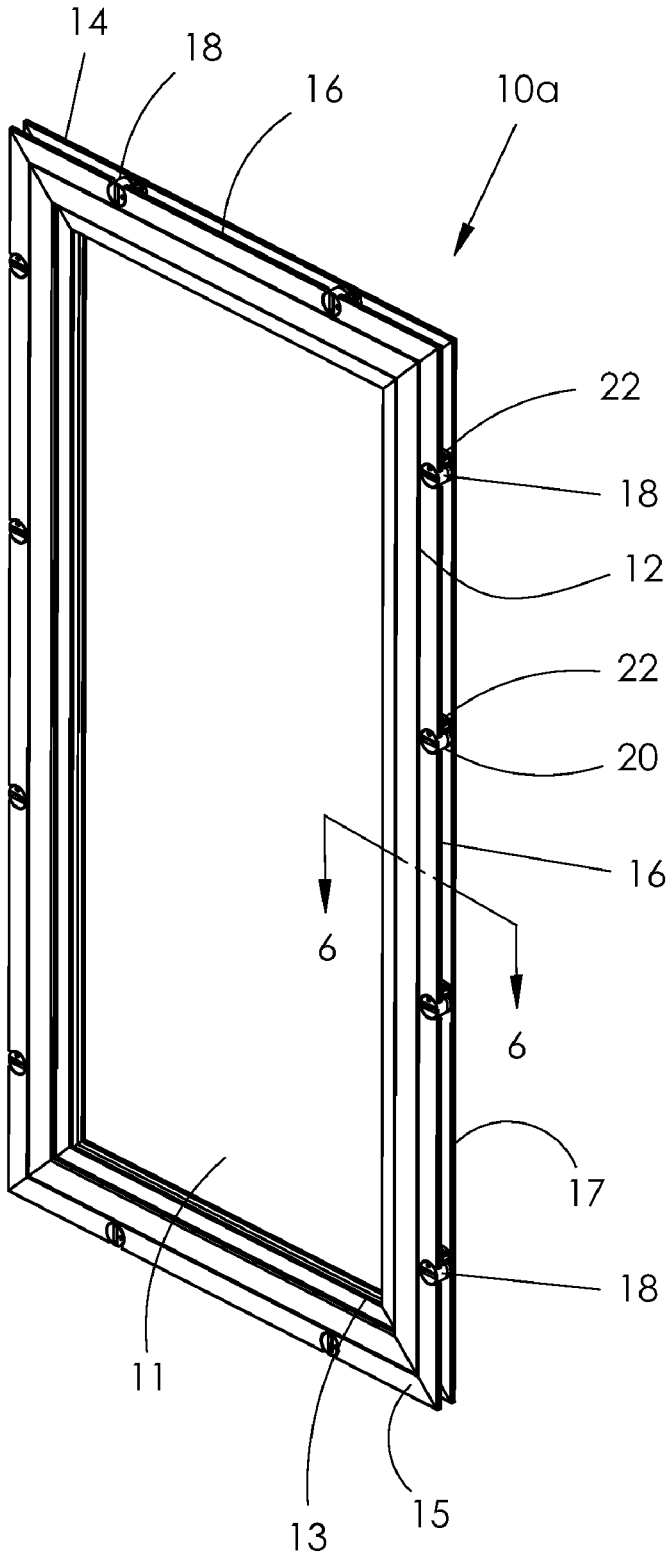
FIG. 5 is a perspective view of a first particular implementation of a removable frame insert.
Figure 6:
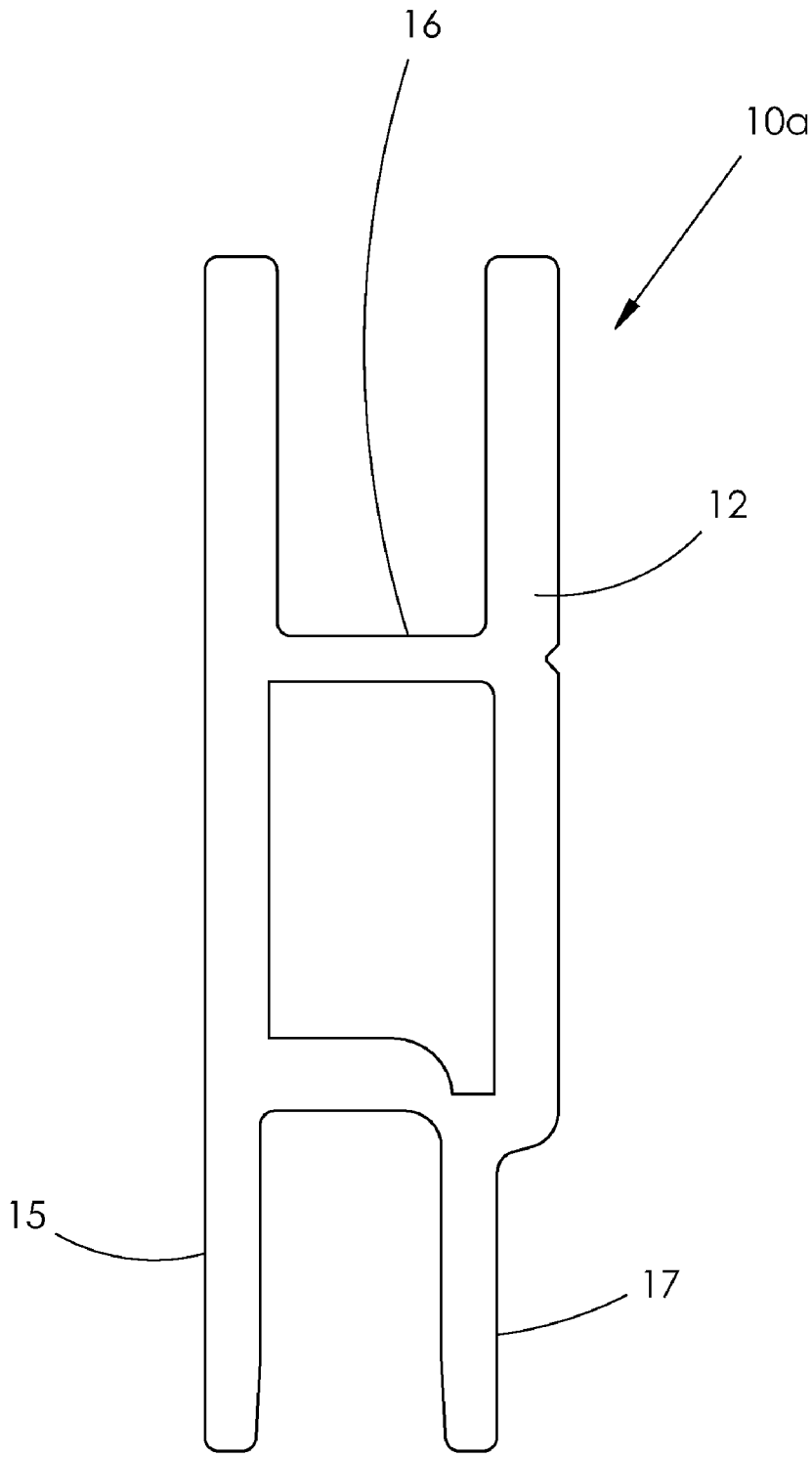
FIG. 6 is a cross-sectional view of the first particular implementation of a removable frame insert shown in FIG. 5, taken along cross-sectional line 6-6.

Still referring to FIGS. 5-8, engagement tab 22 is rotatable (coplanarly with respect to insert 10) between a locked position (FIG. 9) and an unlocked position (FIG. 7). Each of the plurality of recesses 24 has a corresponding annular opening 23 (FIG. 8), into which a pivot 26 of the twisting cam 18 (FIG. 11) is rotatably coupled. Therefore, engagement tab 22 is rotatable between a locked position and an unlocked position via the rotation of pivot 26 with respect to annular opening 23. When engagement tab 22 is in an unlocked position, engagement tab 22 is contained within its respective groove 16 of the insert 12 and the engagement tab 22 does not extend beyond insert perimeter 14 (as shown in FIGS. 5 and 7). By contrast, when engagement tab 22 is in a locked position, at least a portion of engagement tab 22 extends beyond insert perimeter 14 (as shown in the exploded view provided in FIG. 8).

Figure 9:
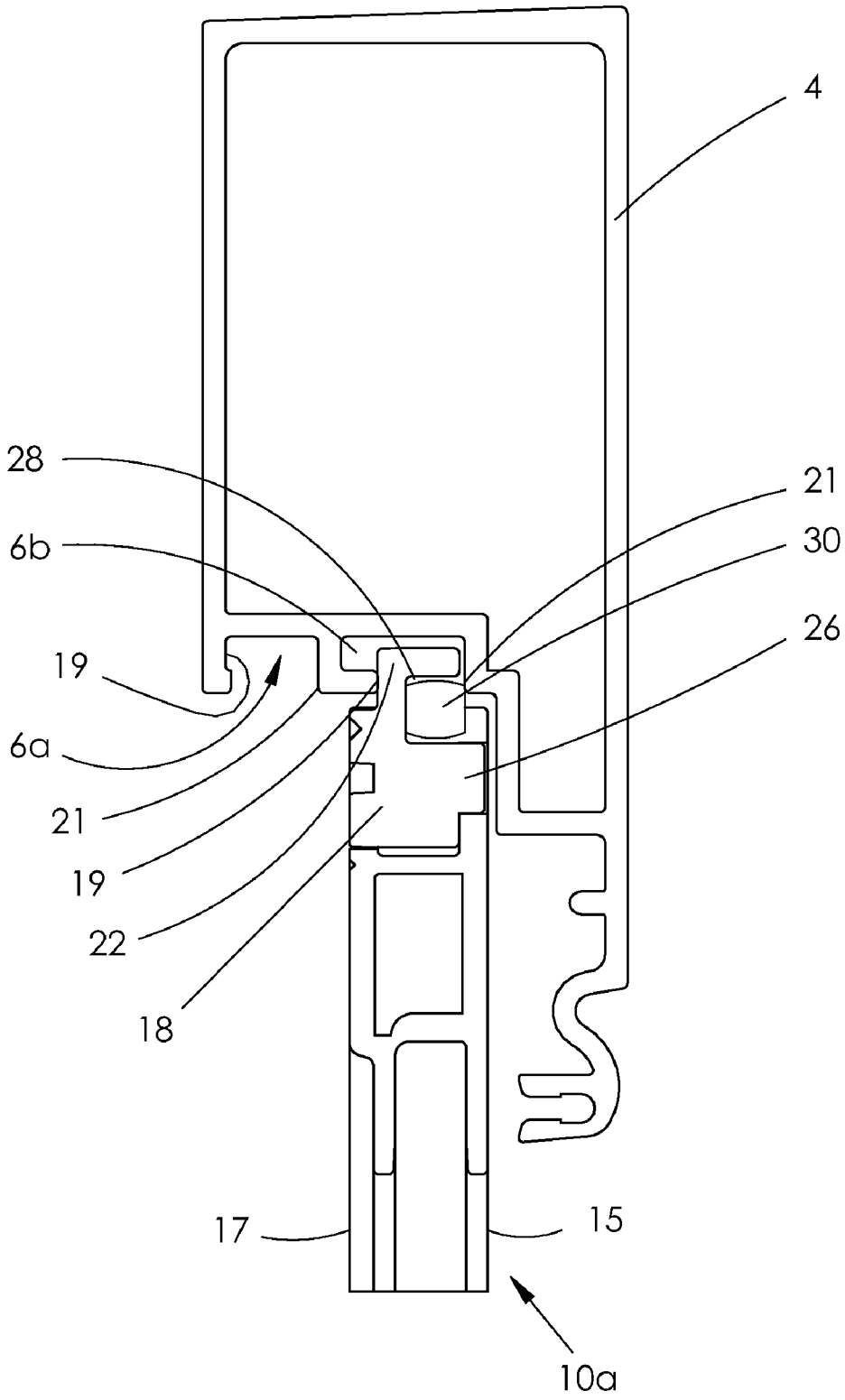
FIG. 9 is a cross-sectional view of an engagement tab with resilient deformable structure impinged in a frame channel of FIG. 8, taken along cross-sectional line 9-9 but with the frame of FIG. 3 included.
Figure 10:
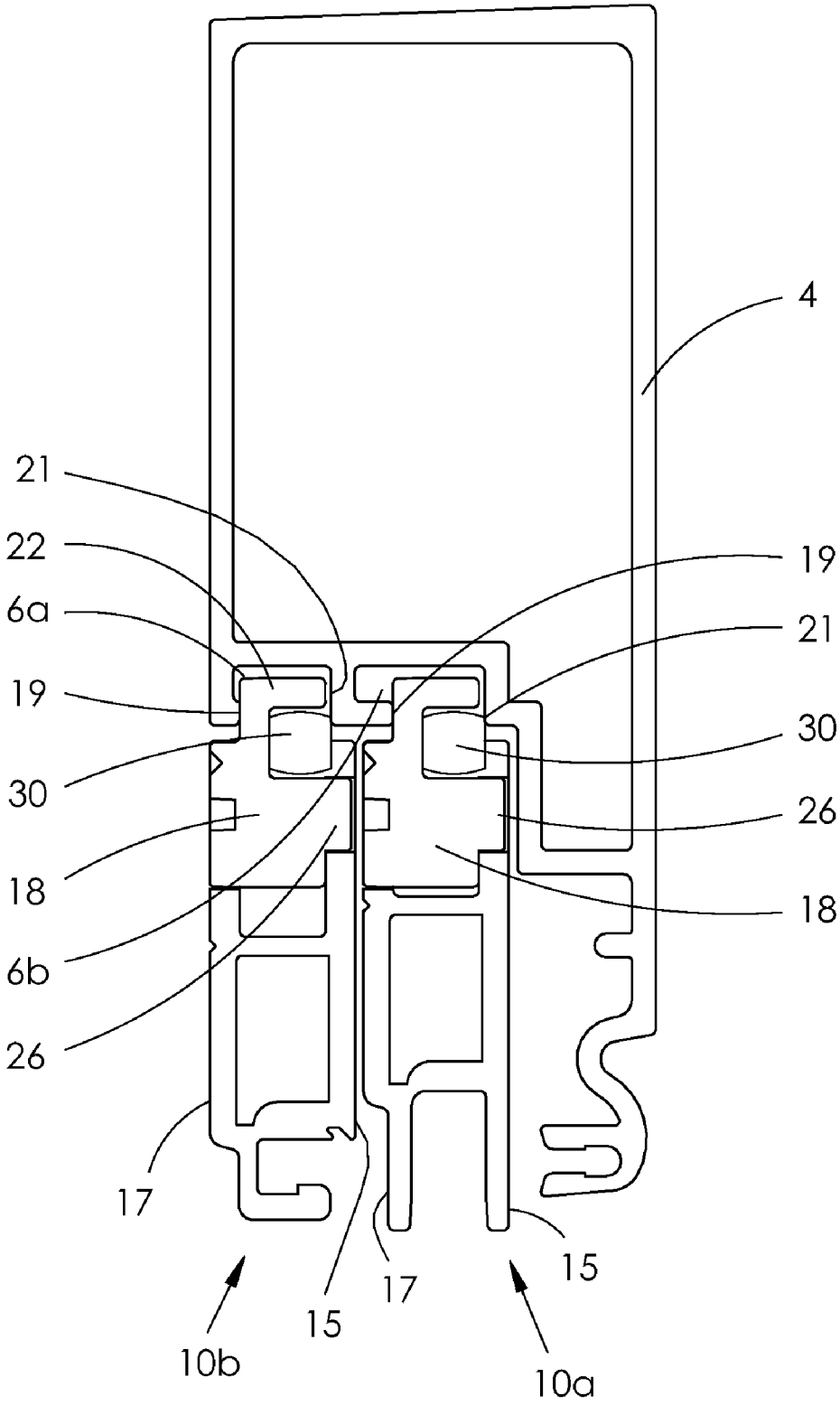
FIG. 10 is a cross-sectional view of two removable frame inserts held in a fixed position with respect to the frame shown in FIG. 2, like the cross-section of FIG. 9 but with a second removable frame insert.

Referring now to FIGS. 9 and 10, a frame 4 is shown in cross-section coupled with one frame insert 10*a* (FIG. 9) and two frame inserts 10*a*, 10*b* (FIG. 10), respectively. Referring specifically to FIG. 9, insert 10*a* is held in a fixed position with respect to frame 4 via the placement of at least one of the plurality of twisting cams 18 within the first channel 6*a*. Specifically, with insert 10*a* positioned or seated within opening 7 of frame 4 (with the plurality of twisting cams 18 in unlocked positions and so that the insert perimeter 14 is aligned with the first channel 6*a*), a user may thereafter rotate one or more of the plurality of twisting cams 18 to its locked position. Rotation of one or more twisting cams 18 to a locked position (so that one or more engagement tabs 22 is placed within the first channel 6*a*) will cause the insert 10*a* to be held in a fixed position with respect to the frame 4. The ability to quickly and easily couple the insert 10*a* within an opening 7 of frame 4 will be appreciated by those having ordinary skill in the art.

Figure 12:
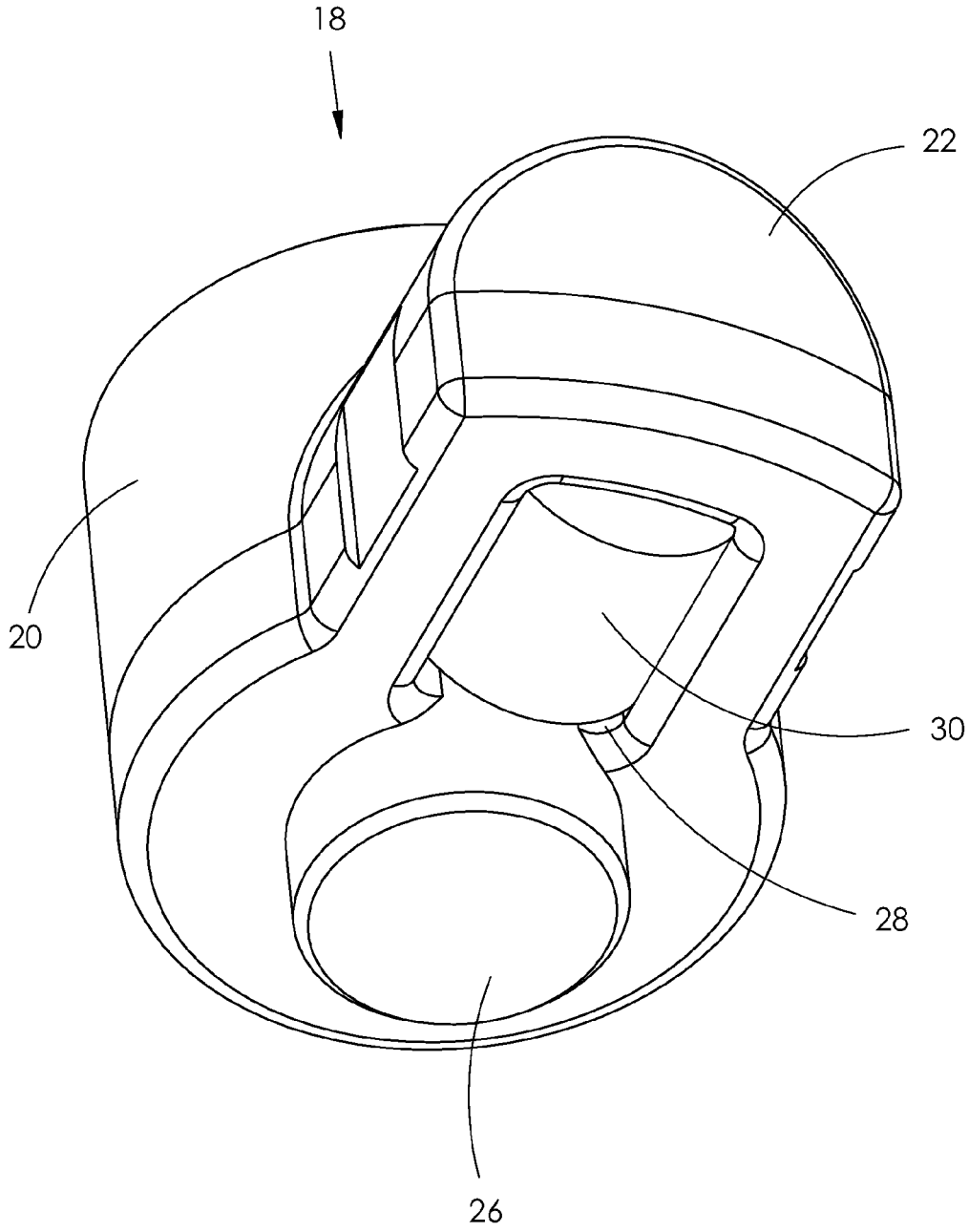
FIG. 12 is an end perspective view of a second implementation of a twisting cam having a resilient deformable structure.

FIG. 12 illustrates a second particular implementation of twisting cam 18. The second implementation of twisting cam 18 may be identical in all respects to twisting cam 18, save for the inclusion of a resilient deformable engagement structure 30 on engagement tab 22 (located opposite a rounded engagement surface 23). The placement of engagement tab 22 within one or more channels 6*a*, 6*b* involves the impingement of the resilient deformable engagement structure 30 between a first side 19 and a second side 21 of channel 6*a*, 6*b*, and the contact of the rounded engagement surface 23 with the first side 19 of the channels 6*a*, 6*b*, and the resilient deformable engagement structures 30 in contact with the second side 21 of the channels 6*a*, 6*b*.

Referring specifically to FIG. 10, two frame inserts 10*a*, 10*b* are shown in cross-section coupled with frame 4. With a first insert 10*a* fixed in position with respect to frame 4, a user may thereafter fix in position second insert 10*b* by positioning or seating insert 10*b* within opening 7 of frame 4 and then locking at least one of the plurality of twisting cams 18 with respect to at least one of the at least two channels 6*a*, 6*b*. One or more inserts 10*a*, 10*b* are stackable with respect to one another (as shown by the stacking of insert 10*b* upon insert 10*a*) and both may be fixed with respect to frame 4 even when stacked. In addition, it will be understood that when insert 10*a* and insert 10*b* are stacked, the front surface of insert 10*a* is in contact (and substantially coextensive with) the rear surface of insert 10*b* when insert 10*a* and insert 10*b* are held in a fixed position with respect to the frame 4.

Figure 11:
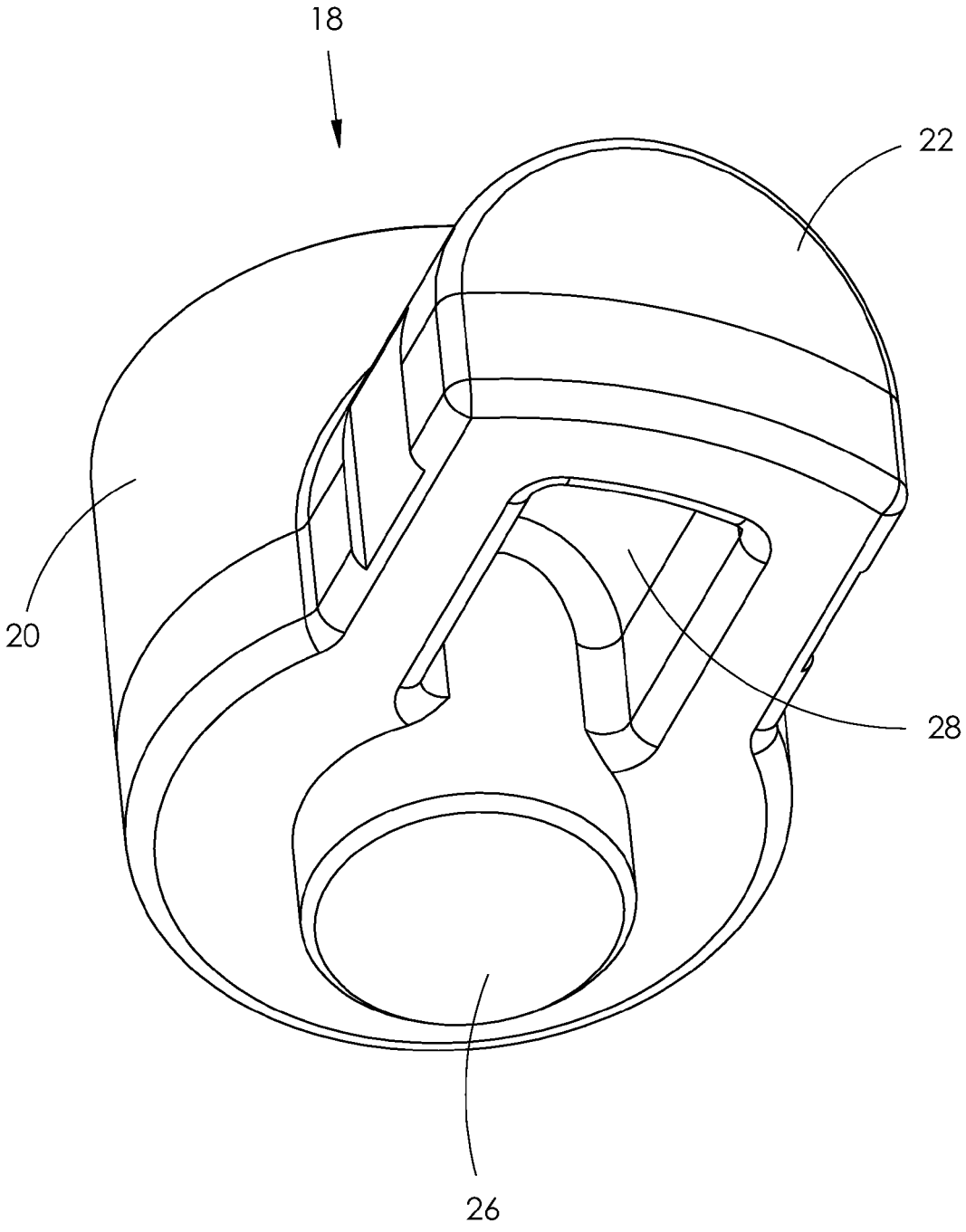
FIG. 11 is an end perspective view of a first implementation of a twisting cam.

FIGS. 11 and 12 illustrate two particular implementations of twisting cams 18. A first implementation of twisting cam 18 (FIG. 11) comprises a twisting cam body 20 (which may comprise a slot or other depression to allow for the rotation of twisting cam 18 via a tool); engagement tab 22 (which extends orthogonally from body 20); pivot 26 (which extends parallel to body 20); and recess 28 (which is disposed on a surface of engagement tab 22 adjacent to pivot 28). A second implementation of a twisting cam 18 (FIG. 12) comprises a twisting cam body 20 (which may comprise a slot or other depression to allow for the rotation of twisting cam 18 via a tool); engagement tab 22 (which extends orthogonally from body 20); pivot 26 (which extends parallel to body 20); and recess 28 (which is disposed on a surface of engagement tab 22 adjacent to pivot 28). In the second implementation of twisting cam 18, the engagement tab 22 comprises a first side and a second side. A rounded engaging surface 23 is provided on the first side of engagement tab 22, and a resilient deformable engagement structure 30 is provided on the second side of the engagement tab 22 (within recess 28 and opposite the first side). It should be clear that in implementations where a resilient deformable engagement structure 30 is not used, or where a different configuration of a resilient deformable engagement structure 30 is used, the recess 28 may be optional.

Many advantages are therefore made possible, either in combination or separately, from particular implementations of storm door assembly for a doorway to a building disclosed in the present application. Those advantages relate, among other things, to assembly, adjustment and fixing in position storm door inserts.

It will be understood that storm door assembly implementations are not limited to the specific parts, devices and components disclosed in this document, as virtually any parts, devices and components consistent with the intended operation of a storm door assembly implementation may be utilized. Accordingly, for example, although particular frames, channels, inserts, insert perimeters, grooves, penannular openings, annular openings, twisting cams, engagement tabs, resilient deformable engagement structures, and other parts, devices and components are disclosed, such may comprise any shape, size, style, type, model, version, class, measurement, concentration, material, weight, quantity, and/or the like consistent with the intended operation of a storm door assembly implementation. Implementations are not limited to uses of any specific parts, devices and components; provided that the parts, devices and components selected are consistent with the intended operation of a storm door assembly implementation.

Implementations of a storm door assembly and implementing components may be constructed of a wide variety of materials. For example, the components may be formed of: polymers such as thermoplastics (such as Nylon, ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as fiberglass), carbon-fiber, aramid-fiber, any combination thereof, and/or other like materials; composites and/or other like materials; natural and synthetic rubbers, elastomers or other like materials; metals, such as zinc, magnesium, titanium, copper, lead, iron, steel, carbon steel, alloy steel, tool steel, stainless steel, brass, tin, antimony, aluminum, any combination thereof, and/or other like materials; alloys, such as aluminum alloy, titanium alloy, magnesium alloy, copper alloy, any combination thereof, and/or other like materials; any other suitable material; and/or any combination of the foregoing thereof.

Some components defining particular implementations of storm door assemblies may be manufactured simultaneously and integrally joined with one another, while other components may be purchased pre-manufactured or manufactured separately and then assembled with the integral components. Various implementations may be manufactured using conventional procedures as added to and improved upon through the procedures described here. For the exemplary purposes of this disclosure, at least insert outer frame 12 and insert panel 11 may be formed separately and then integrally joined together. Also, frame 4 and implementing components may be formed separately and then integrally joined with other components defining a storm door assembly implementation.

Accordingly, manufacture of these components separately or simultaneously may involve vacuum forming, injection molding, blow molding, casting, forging, cold rolling, milling, drilling, reaming, turning, grinding, stamping, pressing, cutting, bending, welding, soldering, hardening, riveting, punching, plating, and/or the like. Components manufactured separately may then be coupled or removably coupled with the other integral components in any manner, such as with adhesive, a weld joint, a solder joint, a fastener, washers, retainers, wrapping, wiring, any combination thereof, and/or the like for example, depending on, among other considerations, the particular material forming the components.

Contemplated implementations of a storm door assembly are many and can apply in many situations. While the specific implementations of a storm door assembly may initially be particularly useful in assisting the efficient and easy assembly, adjustment and fixing in place a storm door insert with respect to a frame, they also have many additional implementations in various other applications for which the desirability of the capabilities of the device described will become readily apparent from the present disclosure. The specific parts, devices and components discussed in this application in no way restrict any possible implementation of the principles here disclosed. Additionally, while particular examples of components may be described in this disclosure, these examples do not serve to limit in any way the potential types of components or reconfigurability that may be implemented. Those skilled in the art will be able with the principles here disclosed to create many potential implementations.

The invention claimed is:

1. A storm door assembly for a doorway to a building, the storm door assembly comprising:

a frame configured for hinged mounting at a doorway of a building, the frame comprising an opening through the frame, the opening comprising a depth and at least two channels disposed in parallel around an inner surface of the depth;

at least two removable frame inserts each comprising a front surface, a rear surface, an insert perimeter comprising a plurality of recesses positioned about the perimeter and a groove disposed along the insert perimeter and located between the front surface and the rear surface, each of the plurality of recesses comprising an opening through the front surface and a corresponding annular opening through the rear surface that is concentric with the opening through the front surface;

a plurality of twisting cams each comprising a pivot extending from a rear side of the twisting cam, wherein each of the plurality of twisting cams is disposed within one of the plurality of recesses such that the pivot of each twisting cam mates with the annular opening of the respective recess and a front portion of each twisting cam extends into the corresponding opening through the front surface;

wherein the at least two frame inserts each held in a fixed position with respect to the frame via placement of the twisting cams within the at least two channels.

2. The storm door assembly of claim 1, wherein the at least two frame inserts are stackable so that the front surface of a first insert of the at least two inserts is in contact with and substantially coextensive with the rear surface of a second insert of the at least two inserts within the depth of the frame when held in its fixed position with respect to the frame.

3. The storm door assembly of claim 1, wherein the at least two channels are disposed concentrically around the inner surface of the frame depth.

4. The storm door assembly of claim 1, wherein the at least two channels are coextensive with the perimeter of the opening through the frame.

5. The storm door assembly of claim 1, wherein the at least two channels comprise one or more discrete, non-contiguous channels.

6. The storm door assembly of claim 1, wherein the opening of each of the plurality of recesses comprises a penannular opening through the front surface into the groove at the perimeter.

7. The storm door assembly of claim 6, wherein the groove is coextensive with the insert perimeter.

8. The storm door assembly of claim 6, wherein the groove comprises one or more discrete, non-contiguous grooves.

9. The storm door assembly of claim 6, wherein the plurality twisting cams disposed within the plurality of recesses are each rotatably coupled within the groove of the at least two frame inserts.

10. The storm door assembly of claim 9, wherein the one or more twisting cams rotate coplanarly with respect to the one or more frame inserts.

11. The storm door assembly of claim 1, wherein the plurality of twisting cams each comprises an engagement tab.

12. The storm door assembly of claim 11, wherein the engagement tab comprises a resilient deformable engagement structure.

13. The storm door assembly of claim 12, the engagement tab further comprising a rounded engaging surface opposite the resilient deformable engagement structure.

14. The storm door assembly of claim 11, wherein an engaging surface of the engagement tab is rounded.

15. The storm door assembly of claim 11, wherein the engagement tab is rotatable between an unlocked position and a locked position, wherein in the unlocked position the engagement tab is contained within the groove of its respective insert and in the locked position at least a portion of the engagement tab extends from the groove of its respective insert.

* * * * *